US012075866B2

(12) United States Patent
Proisy

(10) Patent No.: US 12,075,866 B2
(45) Date of Patent: Sep. 3, 2024

(54) GLOVE ALLOWING DIRECT PALM CONTACT

(71) Applicant: MOURATOGLOU MERCHANDISE, Biot (FR)

(72) Inventor: Sébastien Proisy, Biot (FR)

( * ) Notice: Subject to any disclaimer, the term of this patent is extended or adjusted under 35 U.S.C. 154(b) by 315 days.

(21) Appl. No.: 17/608,571

(22) PCT Filed: Apr. 30, 2020

(86) PCT No.: PCT/IB2020/054073
§ 371 (c)(1),
(2) Date: Nov. 3, 2021

(87) PCT Pub. No.: WO2020/225661
PCT Pub. Date: Nov. 12, 2020

(65) Prior Publication Data

US 2022/0225709 A1 Jul. 21, 2022

(30) Foreign Application Priority Data

May 3, 2019 (FR) ..... 1904686

(51) Int. Cl.
*A41D 19/015* (2006.01)

(52) U.S. Cl.
CPC ..... *A41D 19/01558* (2013.01)

(58) Field of Classification Search
CPC ..... A41D 19/01558; A41D 13/084; A41D 13/087
See application file for complete search history.

(56) References Cited

U.S. PATENT DOCUMENTS 5,125,115 A * 6/1992 Lincoln ..... A41D 31/14 2/159
5,858,054 A * 1/1999 Rosen ..... D04B 1/28 2/2.5

(Continued)

FOREIGN PATENT DOCUMENTS

CN 208145417 11/2018
DE 20120306 8/2002

(Continued)

OTHER PUBLICATIONS

International Search Report from corresponding PCT Appln. No. PCT/IB2020/054073, dated Jul. 10, 2020.

*Primary Examiner* — Tajash D Patel
(74) *Attorney, Agent, or Firm* — Grossman, Tucker, Perreault & Pfleger, PLLC

(57) ABSTRACT

Disclosed is a glove intended especially for racket sports, allowing the almost total preservation of sensations when an object is being held. The glove is open up to the distal phalanges of the fingers in order to preserve maximum contact with a handle, and has gripping material on the fingertips in order to optimise the gripping of the handle and prevent the glove from slipping around the fingers. An elastic part surrounds the wrist, with anti-slip properties on the side next to the skin for better hold. A part covers the entire back of the hand with stretchable material adapted to the temperature, double-fibre material allowing moisture to be transferred outwards and then absorbed. Elastic is provided at the base of the palm (opening side), allowing the hand to close more easily around the handle. The glove is intended, in particular, for any person needing to cover only the back of the hand.

8 Claims, 11 Drawing Sheets

(56) References Cited

U.S. PATENT DOCUMENTS

| | | | | |
|---|---|---|---|---|
| 2015/0059043 | A1* | 3/2015 | Dwyer | A41D 19/01558 2/20 |
| 2016/0184687 | A1* | 6/2016 | Smith | A63B 71/141 2/16 |
| 2016/0235135 | A1* | 8/2016 | Ferrer | A41D 13/084 |
| 2021/0068481 | A1* | 3/2021 | Edwards | A41D 19/0006 |
| 2023/0371628 | A1* | 11/2023 | Villarreal | A63B 71/143 |

FOREIGN PATENT DOCUMENTS

| | | | | |
|---|---|---|---|---|
| JP | 0665416 | | 9/1994 | |
| WO | 2013147463 | | 10/2013 | |
| WO | WO-2018169156 | A1 * | 9/2018 | A41D 19/0017 |

* cited by examiner

[Fig. 1]
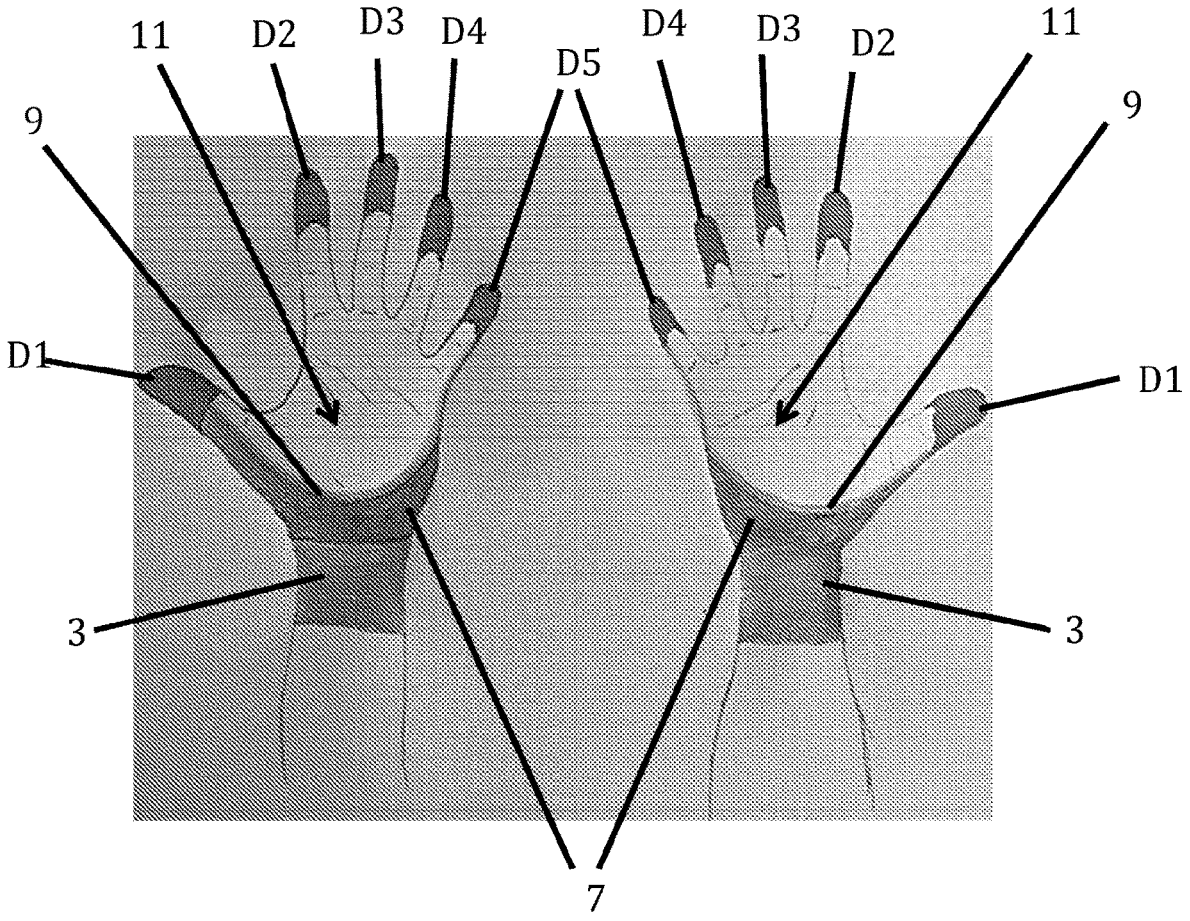

[Fig. 2]
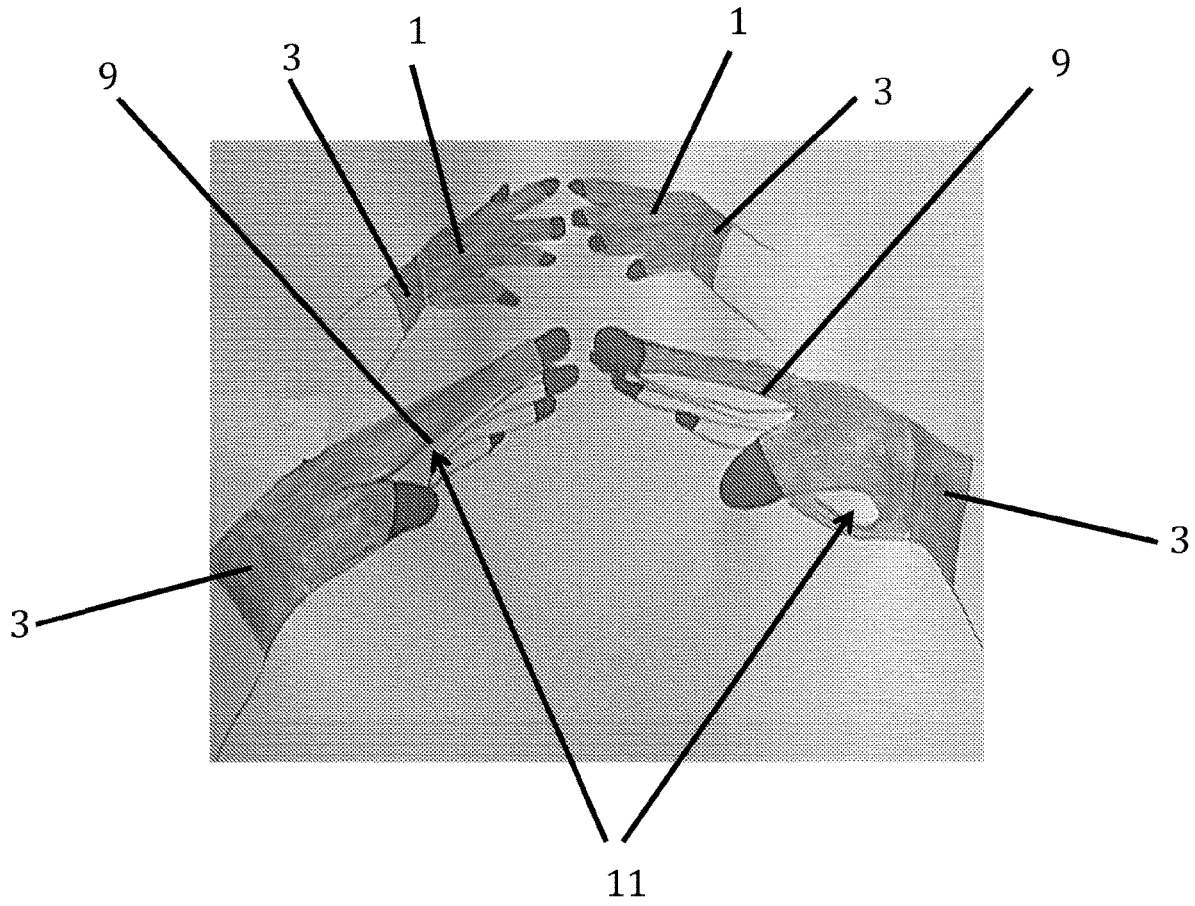

[Fig. 3]
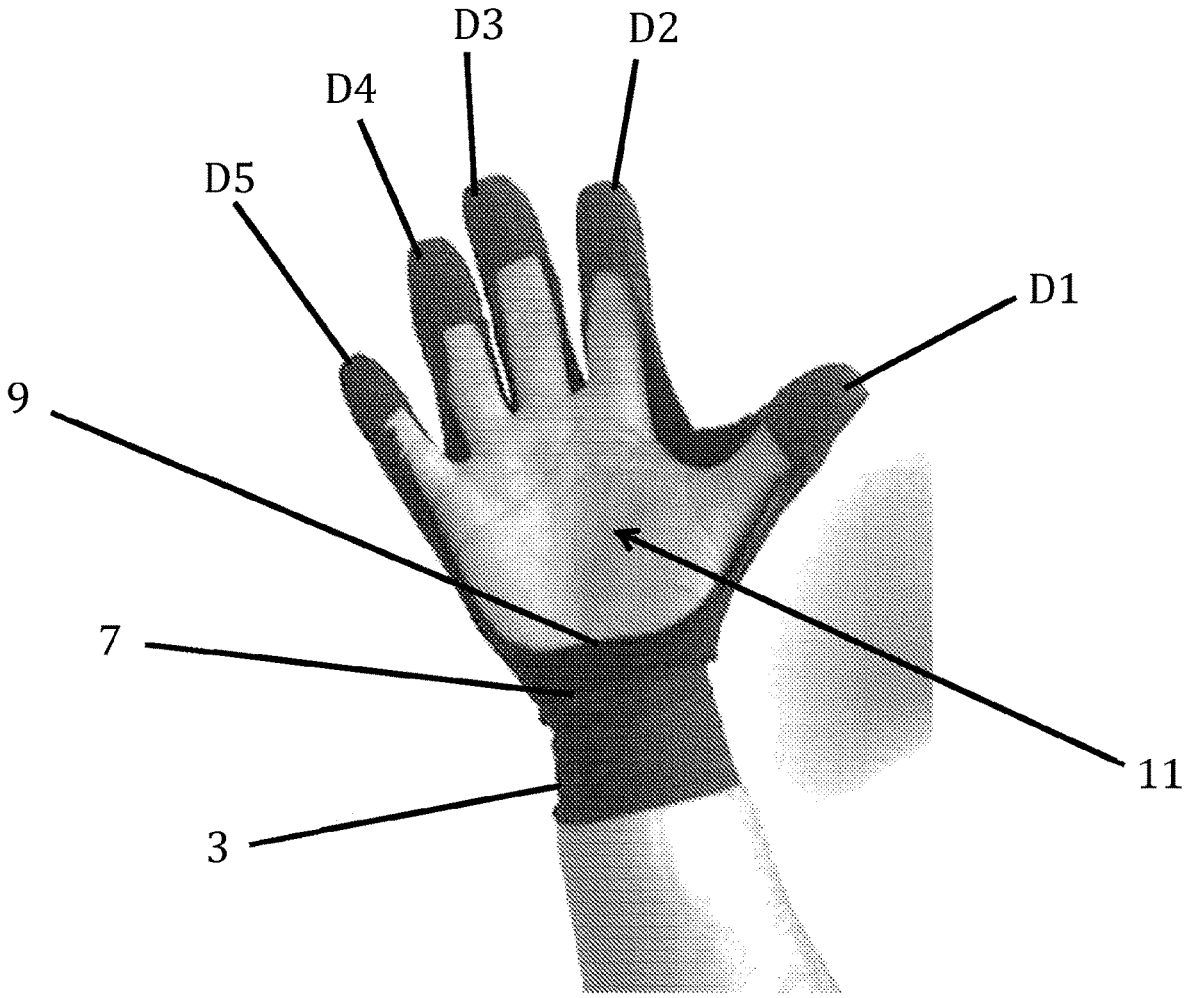

[Fig. 4]
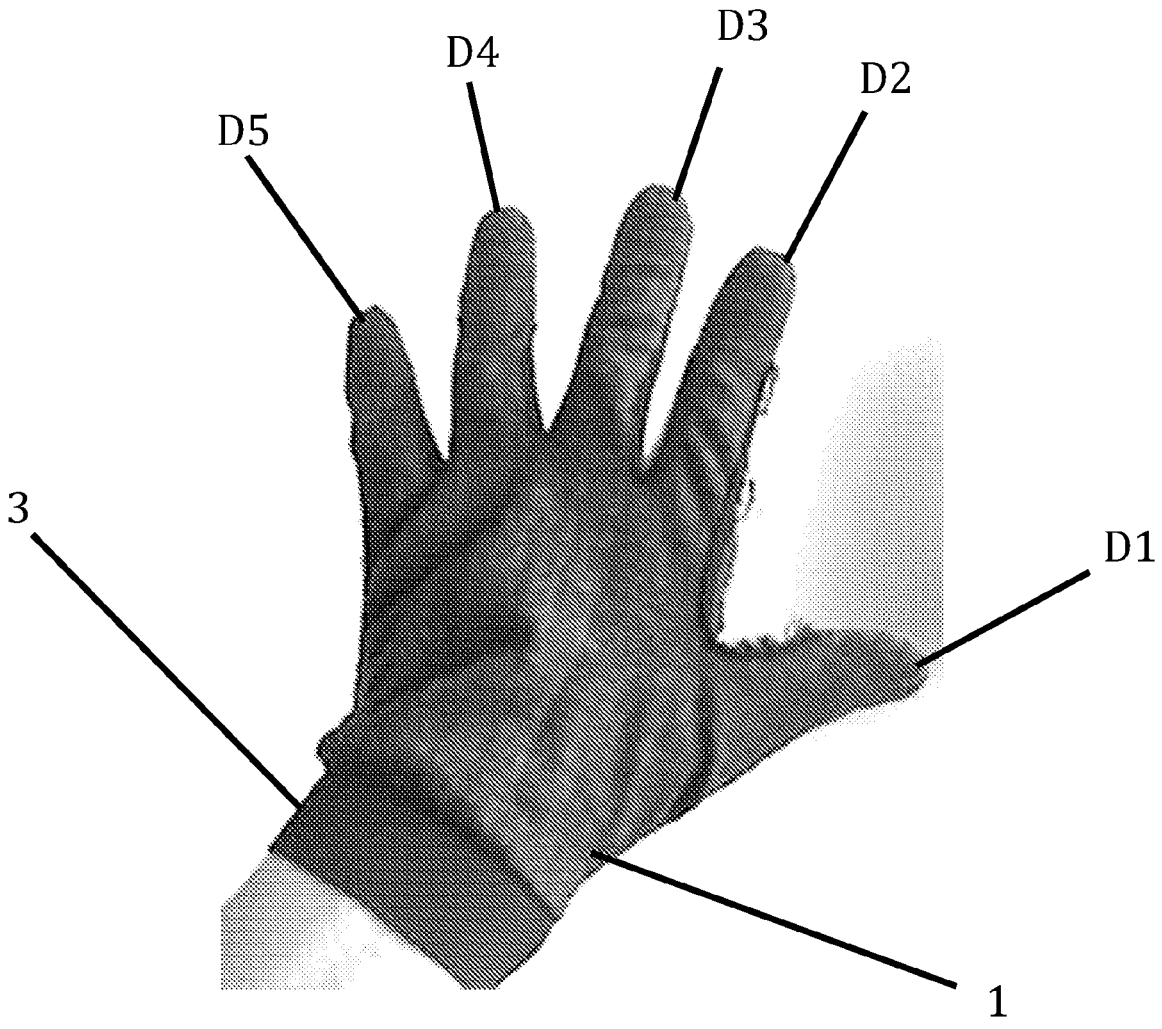

[Fig. 5]
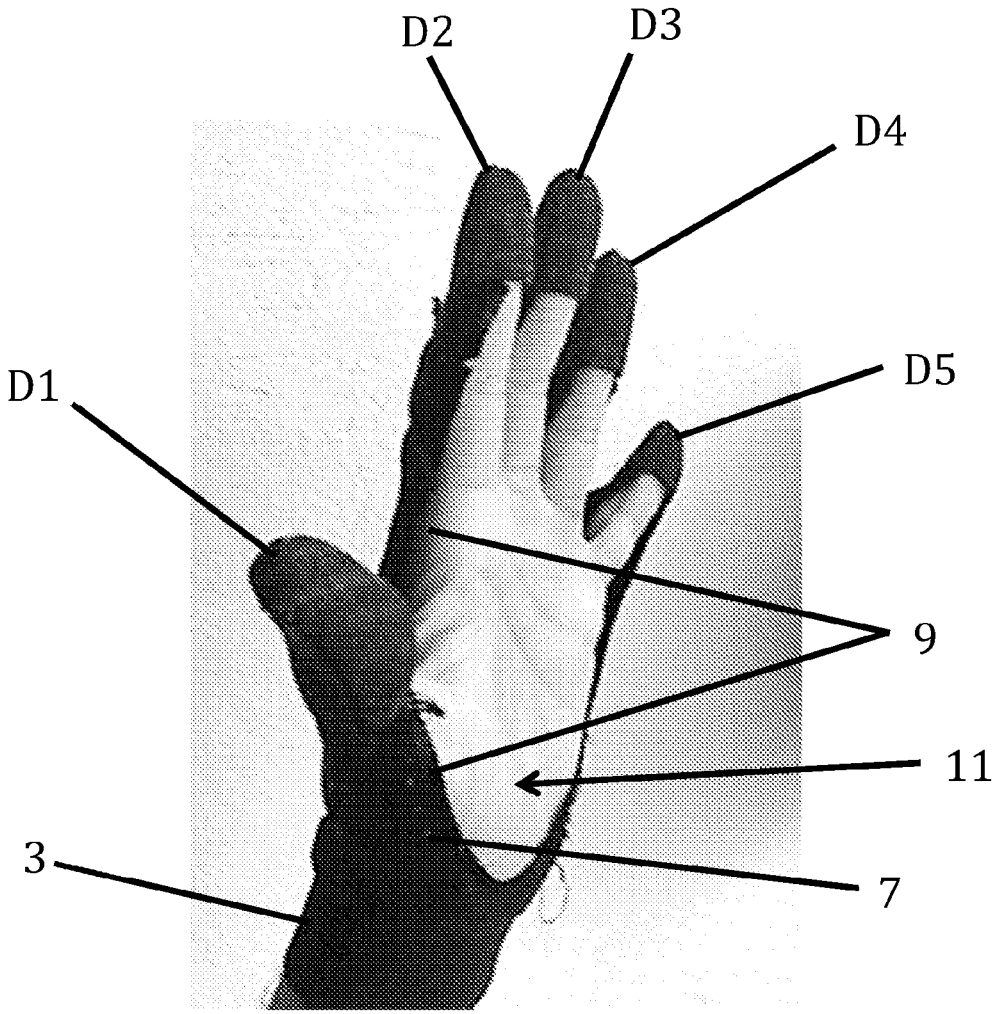

[Fig. 6]
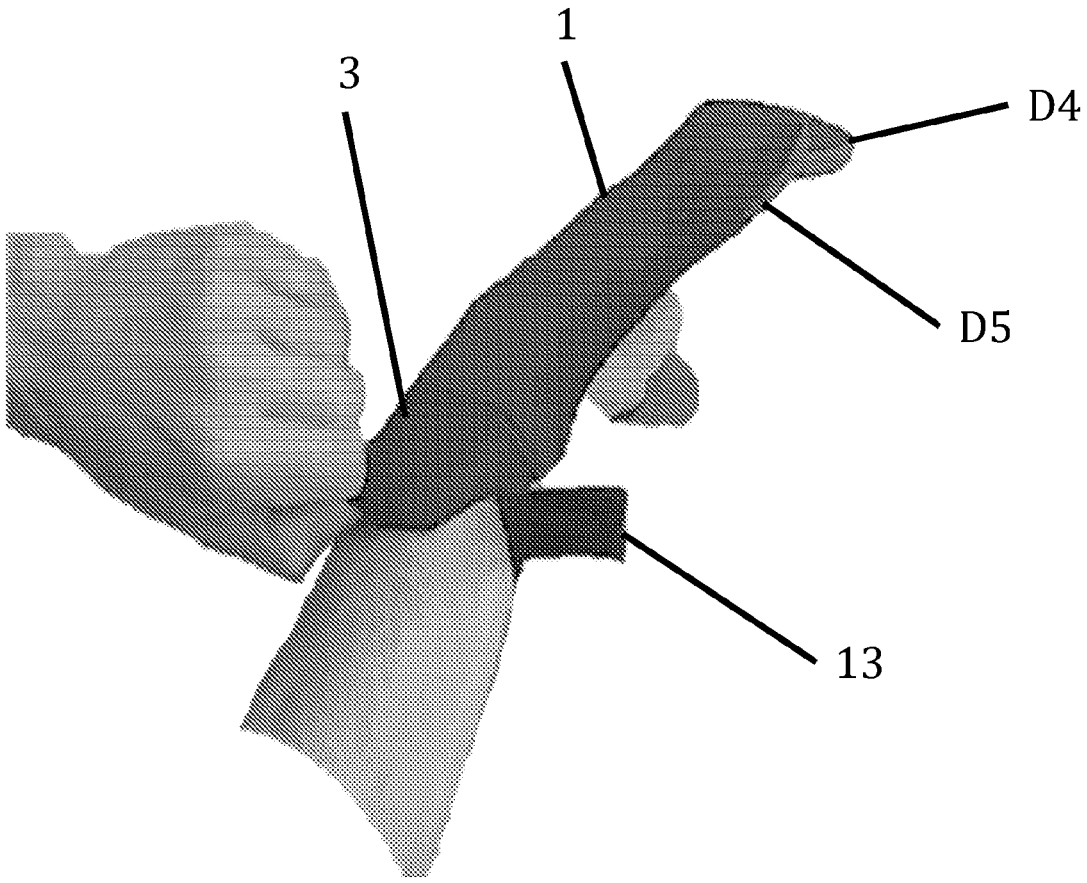

[Fig. 7]
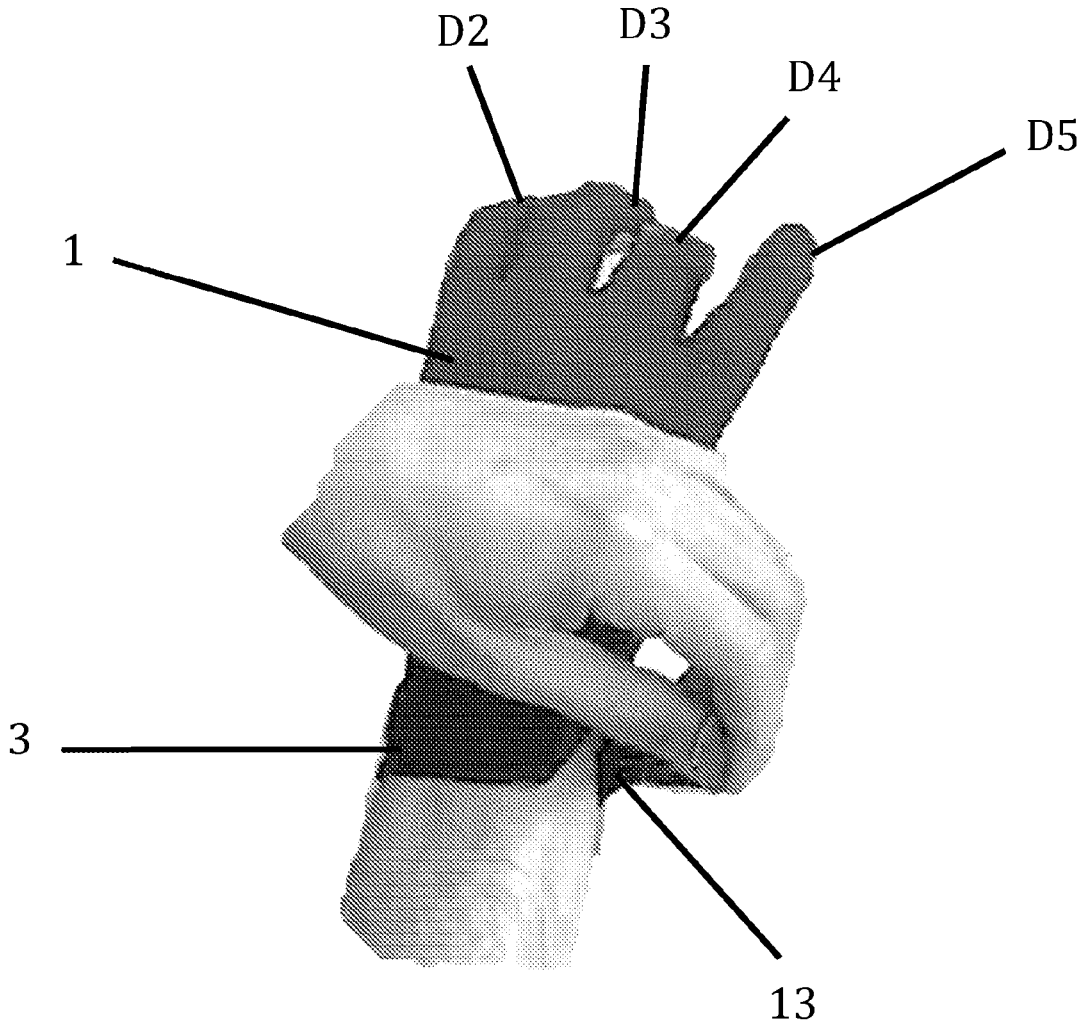

[Fig. 8]
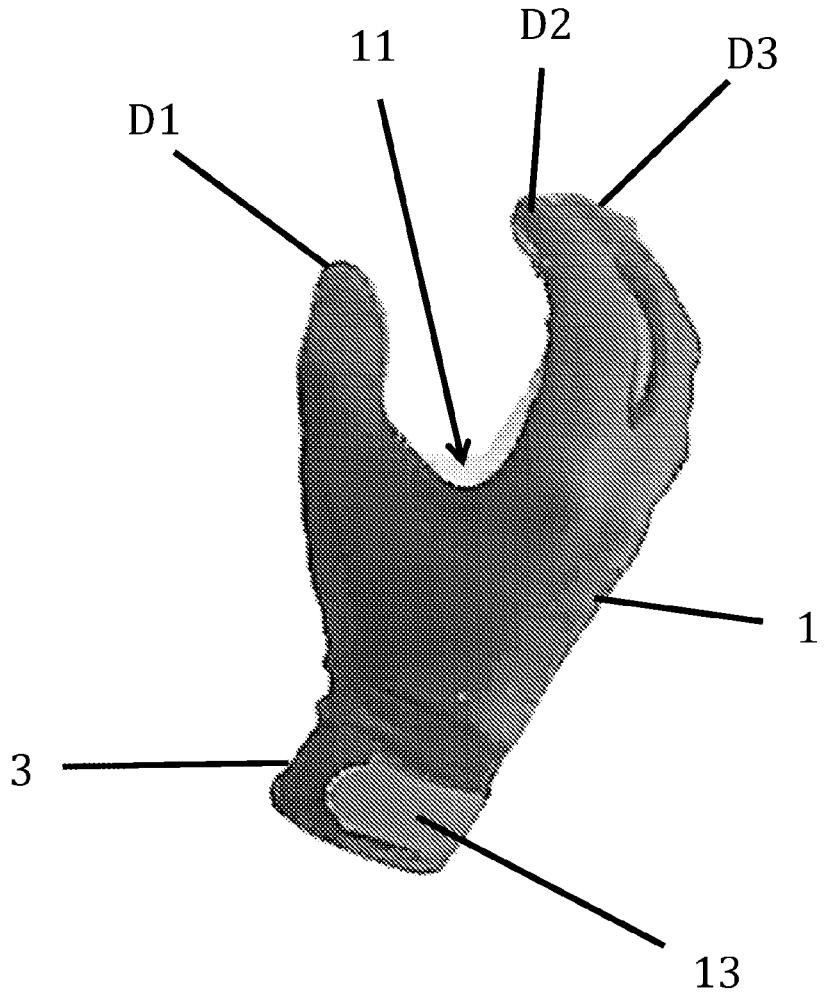

[Fig. 9]
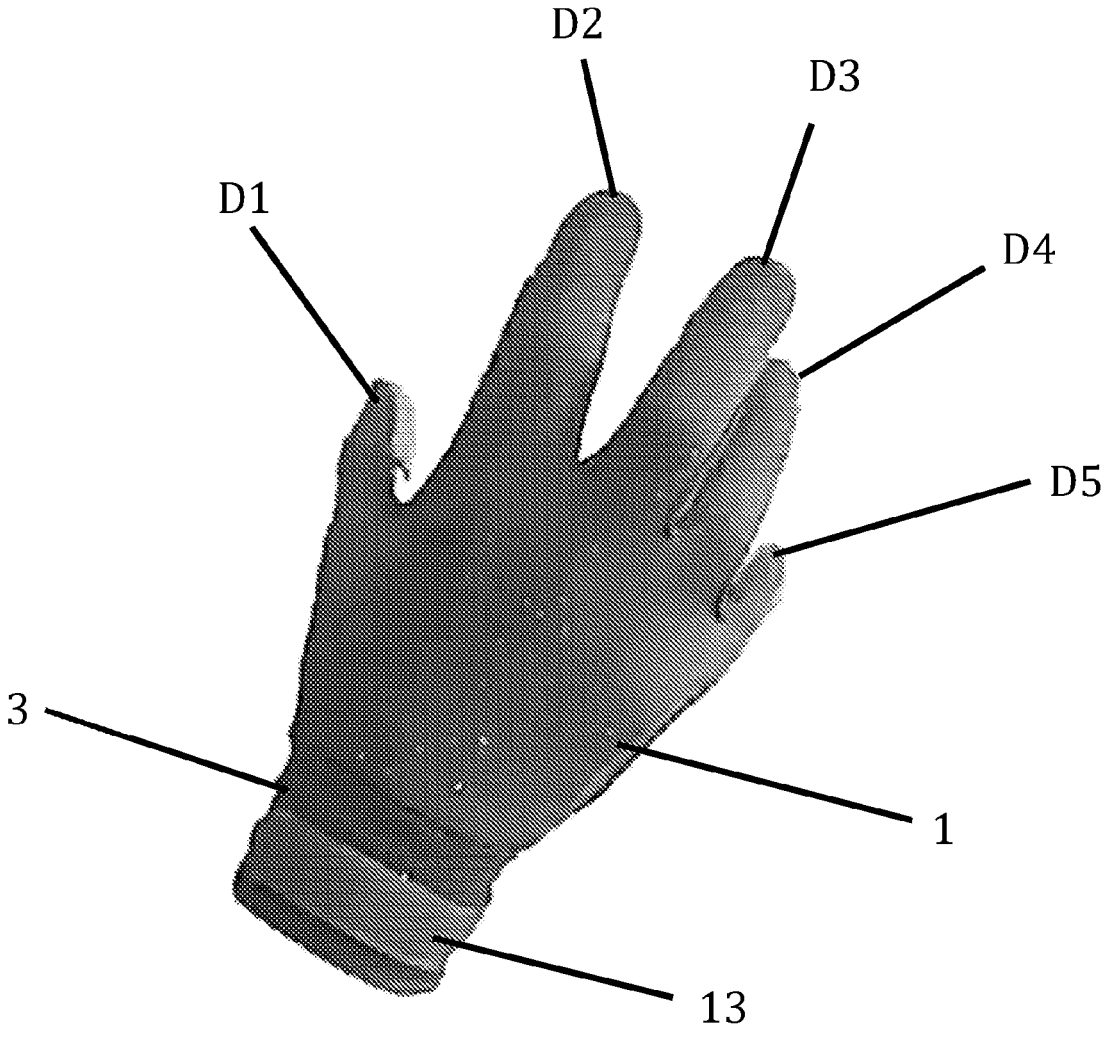

[Fig. 10]
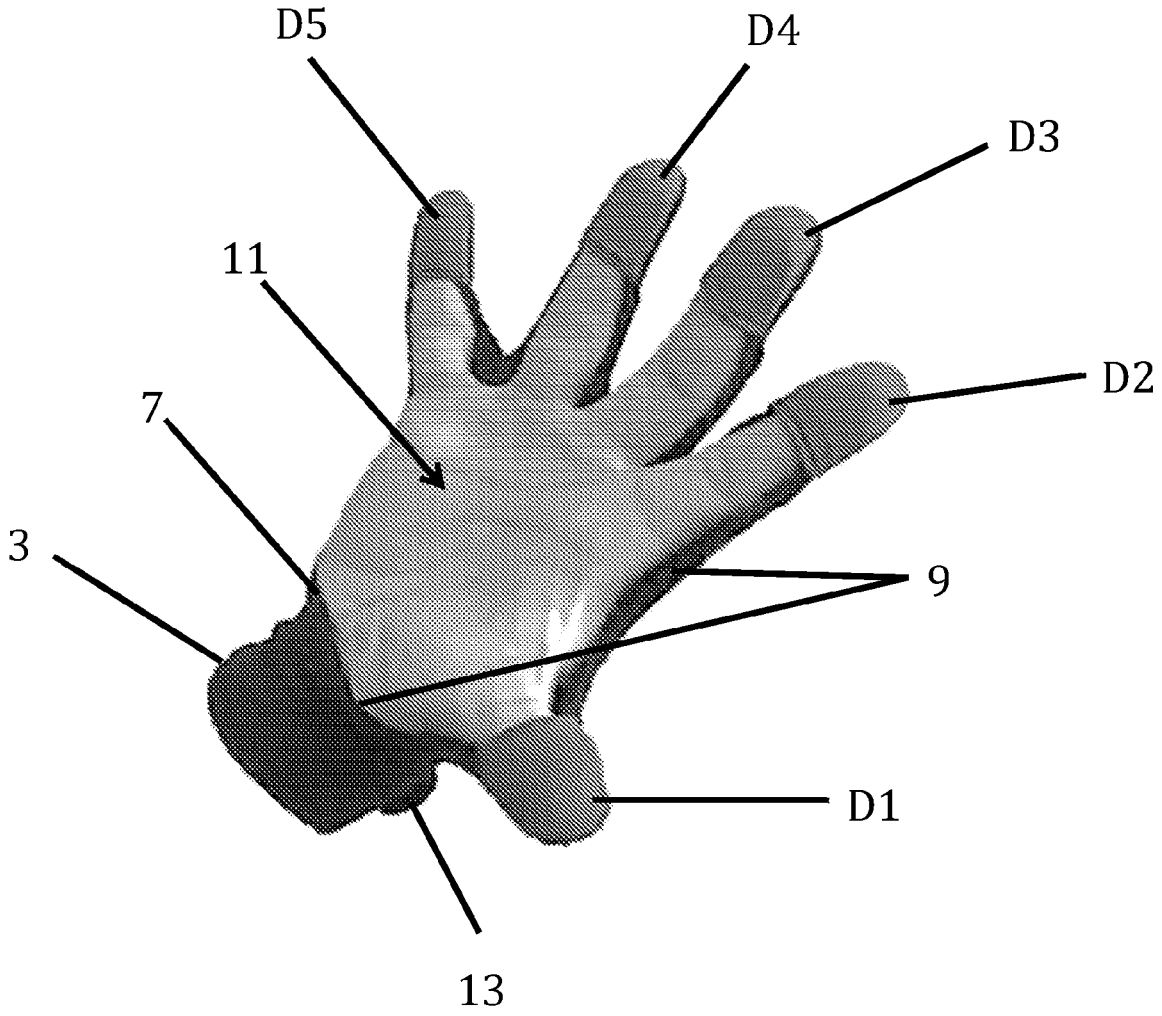

[Fig. 11]
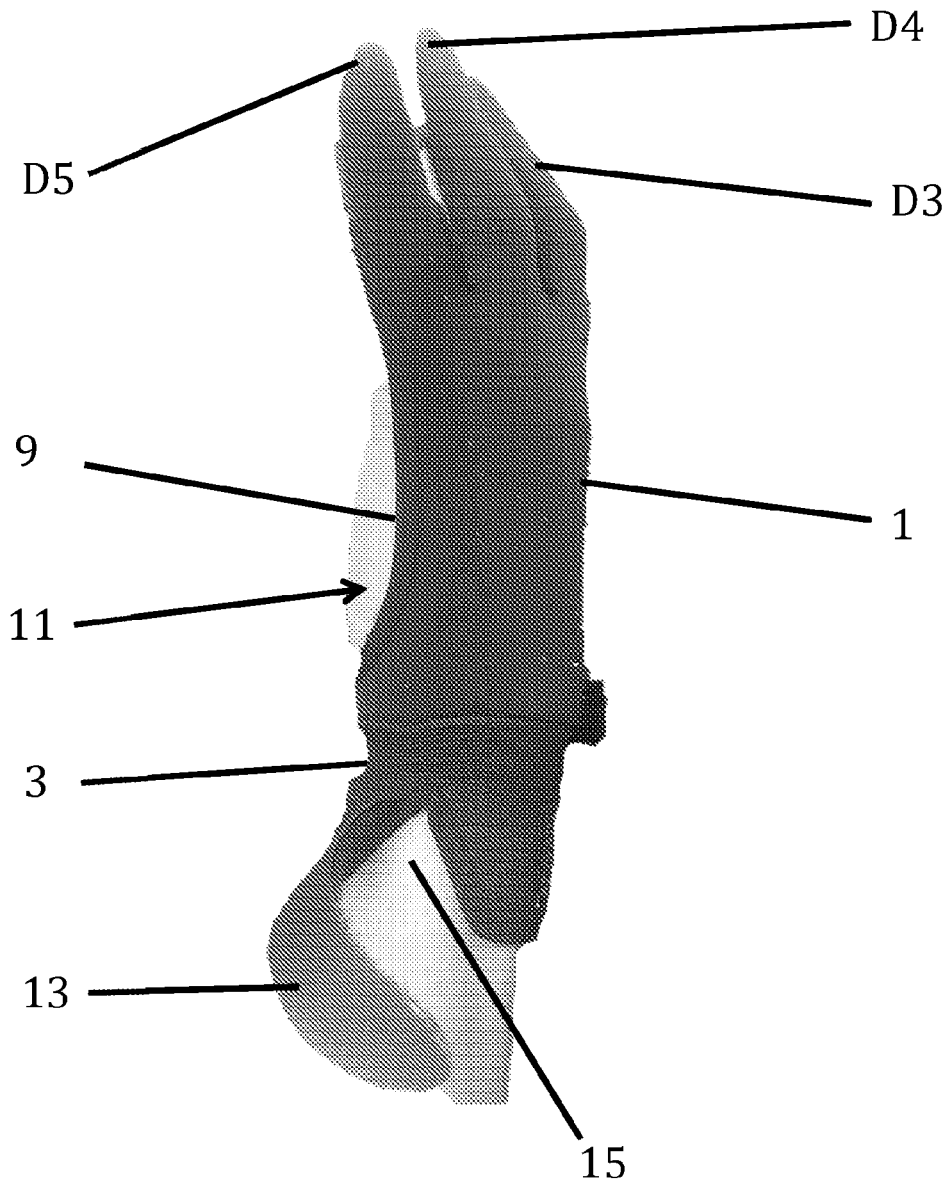

GLOVE ALLOWING DIRECT PALM CONTACT

This application is a US National Stage Application of PCT/IB2020/054073, filed Apr. 30, 2020, and claims priority to French Foreign Patent Application FR1904686 filed May 3, 2019, both of which are incorporated herein by reference in their entirety, The present invention relates to a pair of gloves specially intended to keep direct contact between the palms of the hands and objects of the racquet handle or handlebar type and allows almost total preservation of the sensations when the object is held in hand.

A traditional pair of gloves covers the entire hand and prevents direct contact with the object—tennis racquet or bicycle handlebars, for example. Grip changes often cause folds in the glove material, which further hinders the practice of sport. In addition, the gloves being used mainly in cold weather, they are only used part of the year depending on the climate and require adaptation to handling the racquet with bare hands. Conversely, the switch from prolonged handling of the racquet with a traditional glove whatever it may be to handling with the bare hand can often be accompanied by the appearance of blebs while the hand gets used to it again.

The present invention solves all of these problems while keeping the parts of the hand most susceptible to cold covered. During a game of tennis in the cold, we observe that the parts of the hand most exposed to cold air include the dorsal face of the hand as well as the fingertips which, unlike the rest of the palmar face in direct contact with the handle, are more exposed to cold air. In addition, we know that people most sensitive to cold feel it most at the extremities of the body, in this case at the fingertips or the distal phalanxes. However, none of the gloves designed so far for racquet sports take these criteria into consideration.

The glove according to the present invention comprises 4 parts:

- a part covering only the distal phalanxes of the hand (the fingertips on the palm side as well as the nails) thanks to a fine, non-slip material on the skin side and gripping (silicone or rubber type) on outer side for better support of the object and to prevent the fabric from slipping around the fingers;
- an elastic part going around the wrist with anti-slip properties on the skin side for better support, these properties being obtainable for example by means of silicone screen printing on the fabric on the palm side;
- a part covering the entire dorsal part of the hand with a light, stretchable material adapted to the temperature; and
- a thin elastic slanted part that connects the glove from the little finger to the thumb to maintain the necessary tension.

Preferably, this elastic slanted part also extends along the other fingers to help keep the dorsal part of the glove in tension on the back of the hand and along the fingers, and to improve the finish.

The production of a glove model in accordance with the above makes it possible to protect only the back of the hand and allows contact with a majority of the interior surface of the hand.

Opening of the glove up to the first phalanx of the thumb and up to the second for the other 4 fingers to maintain maximum contact with the handle of the racquet.

Only the first phalanxes starting from the free end of the fingers are therefore covered by the glove.

Gripping material on the fingertips on the outside to optimize the grip of the handle and non-slip on the inside (skin side) to prevent slipping around the fingers. Elastic slanted part especially on the bottom of the palm (opening side) which makes it easier to close the hand on the handle.

Material of the dorsal part in double stretchable fiber allowing to transfer moisture to the outside and then to absorb it.

This glove can be used for a sportsman who uses a handle or a handlebar, it can also be used to protect the hands from the sun in the event of exposure in certain countries, it makes it possible to protect the hand from the cold in the case of sport practiced in outdoors or in a humid environment, and has the particularity of keeping contact with the inside of the hand to allow direct contact with objects. This glove according to the invention is particularly intended for all persons needing to cover only the part of the back of the hand.

The present invention therefore provides, according to the appended claims, a glove comprising:

- a part covering only the distal phalanxes of the hand, comprising a gripping material on the exterior side,
- an elastic part going around the wrist,
- a part covering the entire dorsal part of the hand,
- an elastic slanted part which notably connects the glove of the little finger to the thumb to maintain the necessary tension, said glove covering only the fingertips on the palm side, the dorsal part and the lower part of the palm of the hand.

Thanks to these characteristics, the glove according to the invention makes it possible to completely free the palmar space of the hand located between the wrist and the ends of the fingers: no part of fabric, no band is located in this zone, which allows perfect contact of the palm of the hand with the racquet or handlebars to be held, without the risk of blebs caused by bits of parasitic fabric.

The back covering part provides protection for the back of the hand, whether against the cold or against sunburn.

According to other optional characteristics of the glove according to the invention, taken alone or in combination:

- the gripping material is of the silicone or rubber type on the outside of said part covering only the distal phalanxes of the hand: this material allows excellent gripping of the racquet or the handlebars, while ensuring fineness of the material;
- said part covering only the distal phalanxes of the hand comprises an anti-slip material on the skin side;
- the elastic part around the wrist has anti-slip properties on the skin side: these anti-slip properties allow the glove to hold the glove very well on the wrist, and in particular make it possible to prevent this elastic part from turning on wrist;
- said elastic part going around the wrist comprises a silicone screen printing on the palm side; such screen printing, which can for example take the form of wavelets, makes it possible to obtain the desired anti-slip properties in a simple and inexpensive manner;
- said part covering only the distal phalanxes of the hand is formed in a gripping material on the palm side, and of the material covering the dorsal part of the hand on the fingernail side: in this particular embodiment, it is possible to produce in two different materials on the one hand the part of the glove which covers the ends of the finger on the palm side, and on the other hand the dorsal part of the glove, the seam between these two materials then being made on the side of the ends of the fingers, so as not to interfere with the gripping the racquet or handlebars;

said elastic part going around the wrist comprises adjustable wrist tightening means of the gripping band type: these adjustable tightening means make it possible to very easily adjust the glove to the wrist of its user;

said elastic slanted part also extends along the other fingers to keep the dorsal part of the glove in tension on the back of the hand and along the fingers: this elastic slanted part, which is in fact a sewn elastic border along the free edges of the glove, makes it possible to keep these edges under tension, and thus to ensure a good maintenance of the whole of the glove on the hand, and in particular a plating of the dorsal part of the glove on the back from the hand; this elastic slanted part also makes it possible to obtain a good finish of the free edges of the glove.

Other characteristics and advantages of the present invention will become apparent in the light of the description which follows, and on examination of the appended figures, in which:

FIG. 1 is a front view, palm side, of a pair of left and right hands fitted with gloves according to the invention;

FIG. 2 are two side views of these two pairs of hands fitted with gloves according to the invention, from two slightly different angles making it possible to see the palmar and dorsal parts of the hands respectively;

FIG. 3 is a front view, palm side, of a right hand fitted with a glove according to the invention;

FIG. 4 is a back view, dorsal side, of a left hand fitted with a glove according to the invention;

FIG. 5 is a side perspective view of a left hand fitted with a glove according to the invention;

FIG. 6 is a side view and in perspective of a user putting on an improved glove according to the invention on his right hand;

FIG. 7 is a view similar to that of FIG. 6 of the next step in putting on the improved glove, comprising the tightening of the glove around the wrist of the right hand;

FIG. 8 is a side view in perspective of a right hand fitted with this improved glove according to the invention, after tightening around the wrist;

FIG. 9 is a back view in perspective of a right hand fitted with this improved glove according to the invention, after tightening around the wrist;

FIG. 10 is a front and perspective view of a right hand fitted with this improved glove according to the invention, after tightening around the wrist; and FIG. 11 is a perspective view of a detail of the tightening area of the improved glove on the wrist.

In all of these figures, identical or similar references represent identical or similar members or sets of members.

Referring now to FIGS. 1 to 5, it can be seen that, according to a first embodiment, the glove according to the invention completely covers the back of the hand thanks to a dorsal part 1 formed in a light and stretchable material such as a double fiber fabric, allowing the passage of perspiration to the outside, and its absorption.

The wrist of the hand is surrounded by an annular part 3, formed in a stretchable material which may be similar to that of the material forming the back part 1.

This annular part 3 can be formed integrally with the dorsal part 1, or else attached to the latter, for example by stitching.

This annular part 3 can be reinforced by elastic fibers ensuring better retention of the glove around the wrist.

Preferably, this annular part 3 comprises on the inside face, that is to say coming into contact with the wrist, a screen printing in silicone, which may for example take the form of wavelets.

According to one characteristic of the invention, the glove is open on the palm side, as can be seen in particular in FIGS. 1, 3 and 5.

More precisely, only the fingertips, that is to say the end phalanxes of these fingers, are covered by the glove, by end parts D1, D2, D3, D4, D5 of this glove.

These end parts are, in this first embodiment, formed from the same material as that of the dorsal part 1 of the glove, and preferably comprise, on their inner and outer faces on the palmar side, anti-slip parts such as dots or patterns in screen-printed silicone.

Just above the annular part 3 going around the wrist, the glove according to the invention comprises a slanted part 7 covering the lower part of the palm, and held by an elastic border 9 sewn along the free edge of the glove.

As can be seen in particular in FIGS. 3 and 4, this elastic border 9 also extends along the side of the fingers, as far as the end parts D1, D2, D3, D4, D5 of this glove.

This elastic border 9, which exerts a tension on the dorsal part 1 of the glove, ensures the good support of this dorsal part on the back of the hand, and allows a good finish of the free edges of the glove.

This elastic border 9 defines, on the palm side of the hand, an opening 11 freeing practically the entire palm of the hand, the first phalanx of the thumb, and the first two phalanxes of the index, middle and ring fingers and little finger.

FIGS. 6 to 10 illustrate an improved embodiment of the glove according to the invention.

As can be seen more particularly in FIGS. 6 to 9, this improved glove comprises, around the annular part 3 surrounding the wrist, a closure system 13, preferably but not exclusively, of the hook-and-loop type as a Velcro® band, allowing adjustable tightening of the annular part 3 around the wrist.

A slot 15 is provided in the annular part 3, making it possible to easily put on the glove, then to adjust it on the wrist by means of the band 13.

In addition, and as can be seen in particular in FIG. 10, the ends D1, D2, D3, D4, D5 of the glove are formed, on the palm side of the hand, by a material different from that forming the dorsal part 1 of the glove, and attached to this dorsal part by seams made on the side of the fingers.

This differentiation of materials makes it possible to use a material that is more resistant—and a little less light—on the palmar side than on the dorsal side at the end of the fingers, which is more appropriate to ensure optimal contact and grip of the racquet handle or of the handlebars.

The material forming the ends D1, D2, D3, D4, D5 on the palm side is non-slip in order to hold well on the fingers, and it is preferably covered, on the outside, with gripping patterns, for example of silicone.

The materials forming the glove according to the invention are chosen so as to provide the characteristics of stretchability, of porosity to perspiration and of lightness required.

An example of a material which may be suitable for the dorsal part 1 of the glove is a fabric comprising between 85% and 90% of polyester and between 10% and 15% of polyamide+elastane, and an example of a material which may be suitable for forming the end parts D1, D2, D3, D4, D5 on the palm side in the improved embodiment of FIGS. 6 to 10, can be the "HYDROSOFT" fabric referenced 3118HST from the company BALAS TEXTILE, comprising 88% polyamide and 12% elastane.

With such materials, one can typically obtain a glove weighing between 15 and 20 g.

As results from the above description, the glove according to the invention almost completely frees the palm of the hand and the phalanxes of the fingers—except the end phalanxes—which makes it possible to ensure excellent contact with a handle, racquet or handlebars.

No fabric, elastic or other hindrance interferes with the opening defined by the elastic border 9, so that the user does not risk being hampered by parasitic friction that can generate blisters, for example.

The excellent hold of the glove on the back of the hand is ensured by the tension exerted by the elastic border 9, between the end parts D1, D2, D3, D4, D5 encapsulating the last phalanxes of the fingers and the annular part 3 surrounding the wrist.

The adjustable closure 13 makes it possible to best adjust the glove to the shape of the user's wrist.

Of course, the present invention is not limited to the embodiments described and shown, provided by way of simple examples.

What is claimed is:

1. A glove comprising:

a first plurality of parts; wherein each respective first parts covering only a respective distal phalanx of a hand of a wearer, wherein each of the first plurality of parts comprising a gripping material on an outside surface thereof;

a second part coupled to the first plurality of parts, the second part covering the entire dorsal part of the hand;

a third part comprising an elastic border; the third part is coupled to a first one of the first parts corresponding to a little finger of the hand and coupled to a second one of the first parts corresponding to a thumb of the hand; the third part having a slanted orientation on a bottom of a palm side of the hand to maintain a tension on the first one of the first parts corresponding to the little finger of the hand and the second one of the first parts corresponding to a thumb of the hand; and a fourth part coupled to the second part and the third part; wherein the fourth part to be disposed about the wrist of the wearer;

wherein the first plurality of parts and the third part exposing the palm of the hand and exposing the phalanxes up to the first plurality of parts.

2. The glove according to claim 1, wherein the gripping material is of the silicone or rubber type.

3. The glove according to claim 1, wherein said first plurality of parts covering only the distal phalanxes of the hand comprises an anti-slip material on the skin side.

4. The glove according claim 1, wherein the fourth part comprising elastic material and anti-slip properties on a skin side thereof.

5. The glove according to claim 4, wherein the fourth part comprises a silicone screen printing on a palm side thereof.

6. The glove according to claim 1, wherein said first plurality of parts are each formed of a gripping material on the palm side thereof, and from a material that matches a material of the second part.

7. The glove according to claim 1, wherein said fourth part comprises adjustable tightening means.

8. The glove according to claim 1, wherein the third part also extends along the other fingers to keep the dorsal part of the glove in tension on the back of the hand and along the fingers.

* * * * *